US005505055A

United States Patent [19]

Franklin, Jr.

[11] Patent Number: 5,505,055

[45] Date of Patent: Apr. 9, 1996

[54] $CO_2$ SPRAY HEADER ICE MAKER

[76] Inventor: Paul R. Franklin, Jr., 5455 Vernon Blvd., Jacksonville, Fla. 32254

[21] Appl. No.: 338,226

[22] Filed: Nov. 9, 1994

[51] Int. Cl.[6] ..... F25C 3/00

[52] U.S. Cl. ..... 62/74; 62/330; 62/239

[58] Field of Search ..... 62/533, 534, 74, 62/123, 330, 347, 239

[56] References Cited

U.S. PATENT DOCUMENTS

| | | | |
|---|---|---|---|
| 2,020,719 | 11/1935 | Bottoms | 62/74 |
| 3,573,060 | 3/1970 | Casten et al. | 62/347 X |
| 3,813,892 | 6/1974 | Johnson et al. | 62/534 |
| 4,488,407 | 12/1984 | Delano | 62/74 |
| 4,593,536 | 6/1986 | Fink et al. | 62/239 |
| 4,838,039 | 6/1989 | Knodel | 62/330 |
| 5,154,064 | 10/1992 | Franklin | 62/59 |
| 5,295,368 | 3/1994 | Franklin | 62/307 |
| 5,337,579 | 8/1994 | Saia,III et al. | 62/239 |

*Primary Examiner*—William E. Tapolcai
*Attorney, Agent, or Firm*—Jacobson, Price, Holman & Stern

[57] ABSTRACT

Chilling ice is formed in the upper portion of a container by initially replacing ambient atmosphere within said container with an atmosphere comprising, substantially, chilled $CO_2$ gas and thereafter discharging substantially horizontally oppositely directed and spaced apart impinging jets of liquid $CO_2$ and water within said container.

10 Claims, 2 Drawing Sheets

$CO_2$ SPRAY HEADER ICE MAKER

BACKGROUND OF THE INVENTION

1. Field of the Invention

This invention relates to a method and apparatus for impinging opposing jets of water and liquid $CO_2$ against each other within a chilled $CO_2$ atmosphere in order to produce ice which may vary in temperature from 32° F. to −50° F., depending upon the relative rates of spray discharge of water and liquid $CO_2$.

2. Description of Related Art

Various different methods and apparatuses for forming ice by mixing liquid $CO_2$ and water heretofore have been known. Examples of these previous methods and apparatuses are disclosed in U.S. Pat. Nos. 4,838,039, 4,888,407, 5,154,064 and 5,295,368. However, these previously known methods and apparatuses require special equipment and/or are very difficult to precisely control. Accordingly, a need exist for a method and apparatus for forming ice at selected temperatures and wherein the ice may be formed independent of elaborate equipment and in a manner which may be controlled by semiskilled work persons.

SUMMARY OF THE INVENTION

The ice maker of the instant invention incorporates at least one pair of opposing jets for discharging opposing spray jets of liquid $CO_2$ and water toward each other in an atmosphere comprising, substantially, chilled $CO_2$ gas.

Although the spray jets are not confined within a small chamber such as that disclosed in U.S. Pat. No. 4,838,039, ice may not be properly formed if the opposing spray jets are disposed in a normal (air) atmosphere which is appreciably above 32° F. or includes any appreciable amounts of moisture (humidity).

The opposing water and liquid $CO_2$ spray jets of the instant invention are, however, operative to form reasonably large amounts of ice, (in proportion to the amount of liquid $CO_2$ utilized) as long as the surrounding atmosphere is at a temperature below 30° F. and substantially free of humidity.

The ice maker, therefore, is particularly well adapted to form ice within a large food container or the like and with the ice being formed falling by gravity downwardly upon a load of food to be chilled, maintained chilled or maintained frozen and loaded within the container to a height somewhat below the upper wall of the container.

In this manner, fresh produce, chilled produce and/or frozen foods may first be loaded within a container in a conventional economical manner and the ice maker of the instant invention may thereafter quickly form the desired amount of ice for disposition upon the top of the load in an economical manner and without the need for the ice being transported from a supply of ice exteriorly of the container to the interior thereof or any special equipment designed to spread an ice layer over the load within the container.

The main object of this invention is to provide an ice maker which will be capable of forming a desired layer of ice over a load within a storage or shipping container.

Another object of this invention is to provide an ice maker which, other than the mounting of the relatively simple ice maker within the upper portion of the container, will not require the use of any special form of insulated container.

Still another important object of this invention is to provide an ice maker which is relatively inexpensive to produce and which does not require more than semiskilled labor to operate.

A further object of this invention is to provide an ice maker in accordance with the preceding objects and which may be quickly installed within a large shipping container or truck body using only semiskilled labor.

Yet another object of this invention is to provide a method and apparatus for forming ice which will produce a maximum amount of ice for a given poundage of liquid $CO_2$ consumed.

A further object of this invention is to provide an ice maker which may be adjusted, according to the ratio of liquid $CO_2$ and water being spray discharged, to produce ice ranging from 32° F. down to minus 50° F.

A final object of this invention to be specifically enumerated herein is to provide an apparatus in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
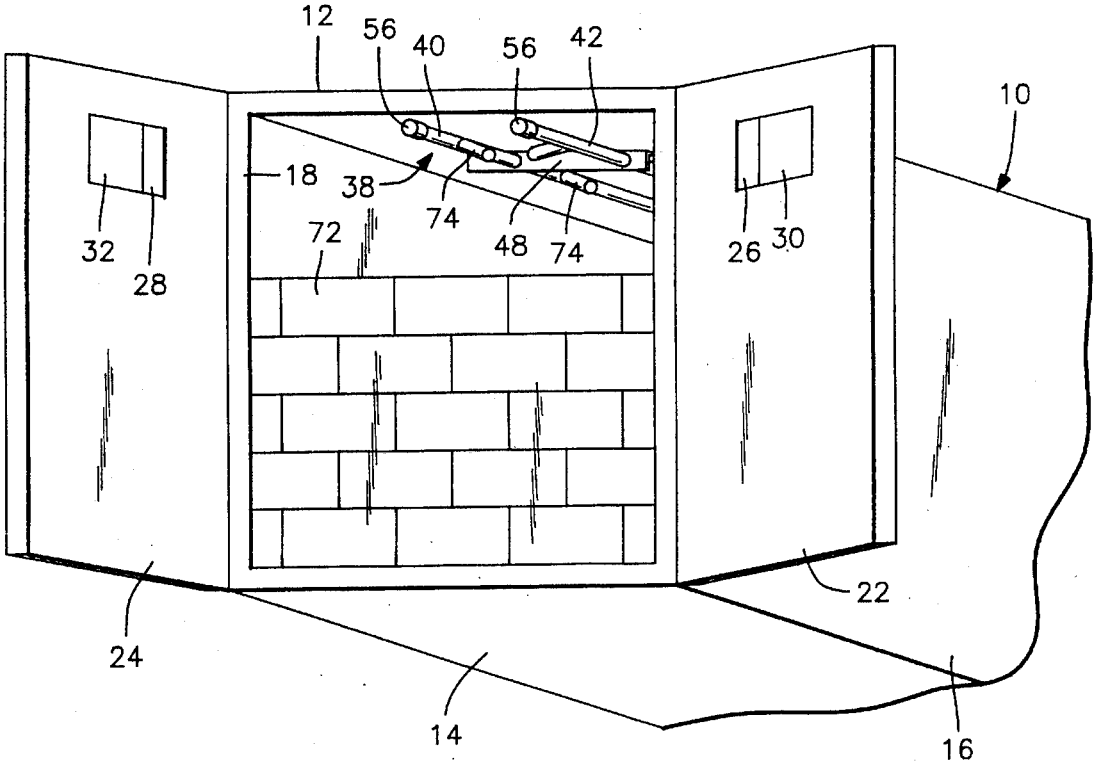
FIG. 1 is a fragmentary perspective view of the rear of an insulated container (a shipping container or truck body) partially loaded with food materials to be iced and with the $CO_2$ spray header ice maker of the instant invention having the rear end thereof illustrated as supported from the top wall of the container.

Referring now more specifically to the drawings the numeral 10 generally designates an insulated storage or shipping container including top and bottom walls 12 and 14, opposite side walls 16 and 18, a front wall 20 and a rear wall comprising a pair of horizontally swingable rear doors 22 and 24, the rear doors 22 and 24 having vent openings 26 and 28 formed therein and having flap or other type closures 30 and 32 operatively associated therewith. Preferably, the openings 26 and 28 are formed in upper portions of the doors 22 and 24 so that, when the doors are closed and chilled $CO_2$ gas is discharged into the interior of the container 10, the ambient atmosphere previously within the container 10 may be effectively substantially fully purged therefrom through the vent openings 26 and 28 by the colder and thus more dense $CO_2$ gas.

A spray header assembly is referred to in general by the reference numeral 38 and includes a pair of substantially parallel copper and stainless steel pipes 40 and 42 suspended closely beneath and extending along the length of the top wall 12. The pipe 40 is required to withstand 150 psig internal pressure and the pipe 42 is required to withstand 300 psig internal pressure. Of course, the pipe 40 also may be constructed of stainless steel, but sufficient strength is obtained through the utilization of copper at a lower cost than stainless steel. Furthermore, it is pointed out that the pipes 40 and 42 are externally insulated.

Corresponding longitudinally spaced portions of the pipes 40 and 42 are passed through vertical depending flanges 46 of angle iron mounting brackets 48 spaced longitudinally of the container 10 and including upper horizontal flanges 50 secured to the underside of the top wall 12 through the utilization of suitable fasteners 52. Thus, it may be seen that the spray header assembly 38, once assembled, may be quickly installed within the container 10.

Corresponding first ends 54 of the pipes 40 and 42 are closed by end caps 56 and the corresponding second ends 58 of the pipes 40 and 42 have supply pipes or hoses 60 sealingly connected thereto and opening into an access recess 62 formed in the front wall 20 and removably closed by a closure door 64. The ends of the supply pipes or hoses 60 disposed within the access recess 62 have quick couplings 66 mounted thereon whereby high pressure supply lines (not shown) for water and liquid $CO_2$ may have their discharge ends quick coupled to the hoses 60.

The pipes 40 and 42, for the purpose of that form of the invention specifically illustrated in the drawings, are 1½ inches in diameter and have T-fittings 68 telescoped thereover and secured thereto in predetermined positions along the pipes 40 and 42 with the T-fittings 68 inclined outwardly and downwardly generally 30° relative to the horizontal and the T-fittings 68 on the pipe 40 opposing corresponding T-fittings 68 on the pipe 42.

Although it has been found that an ice layer 70 may be formed and spread out over the load 72 within the container 10 in an advantageous manner utilizing the T-fittings 68 which are outwardly and downwardly inclined 30° relative to the horizontal, substantially horizontally directed T-fittings or T-fittings inclined less than 30° may be used.

The opposing ends 74 of the T-fittings define spray horns and each of the pipes 40 and 42 is provided with a spray jet aperture 76 of approximately 3/32 inch in diameter which opens outwardly of the corresponding pipe 40, 42 and centrally outwardly through the corresponding horn 74. The pipes, in the installation illustrated in the drawings, are spaced approximately 10½ inches apart and the horns are approximately 1½ inches long, whereby the opposing ends of the horns are spaced approximately 7½ inches apart.

In operation, the load 72 is initially loaded into the container 10 to the approximate height illustrated in FIG. 1 or to a somewhat higher elevation. The load 72 may comprise ambient temperature produce, chilled produce, chilled meats or frozen meats and produce.

Figure 3:
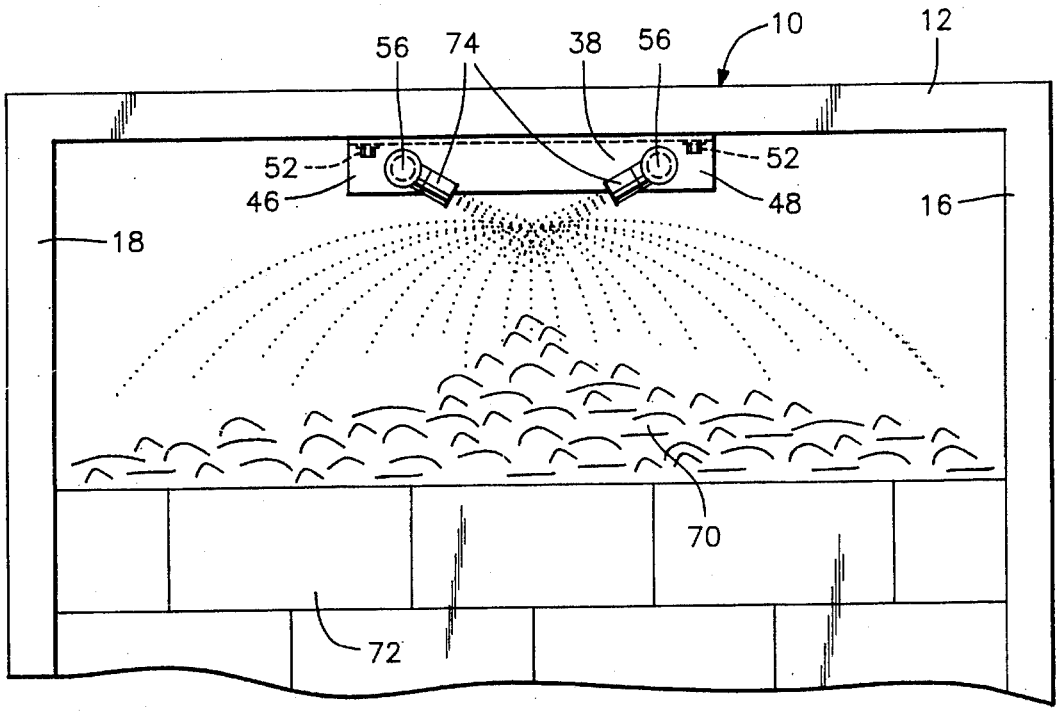
FIG. 3 is a fragmentary enlarged rear elevational view of the upper portion of the assemblage illustrated in FIG. 1 and with the rear horizontally swingable closure doors of the container removed.
Figure 2:
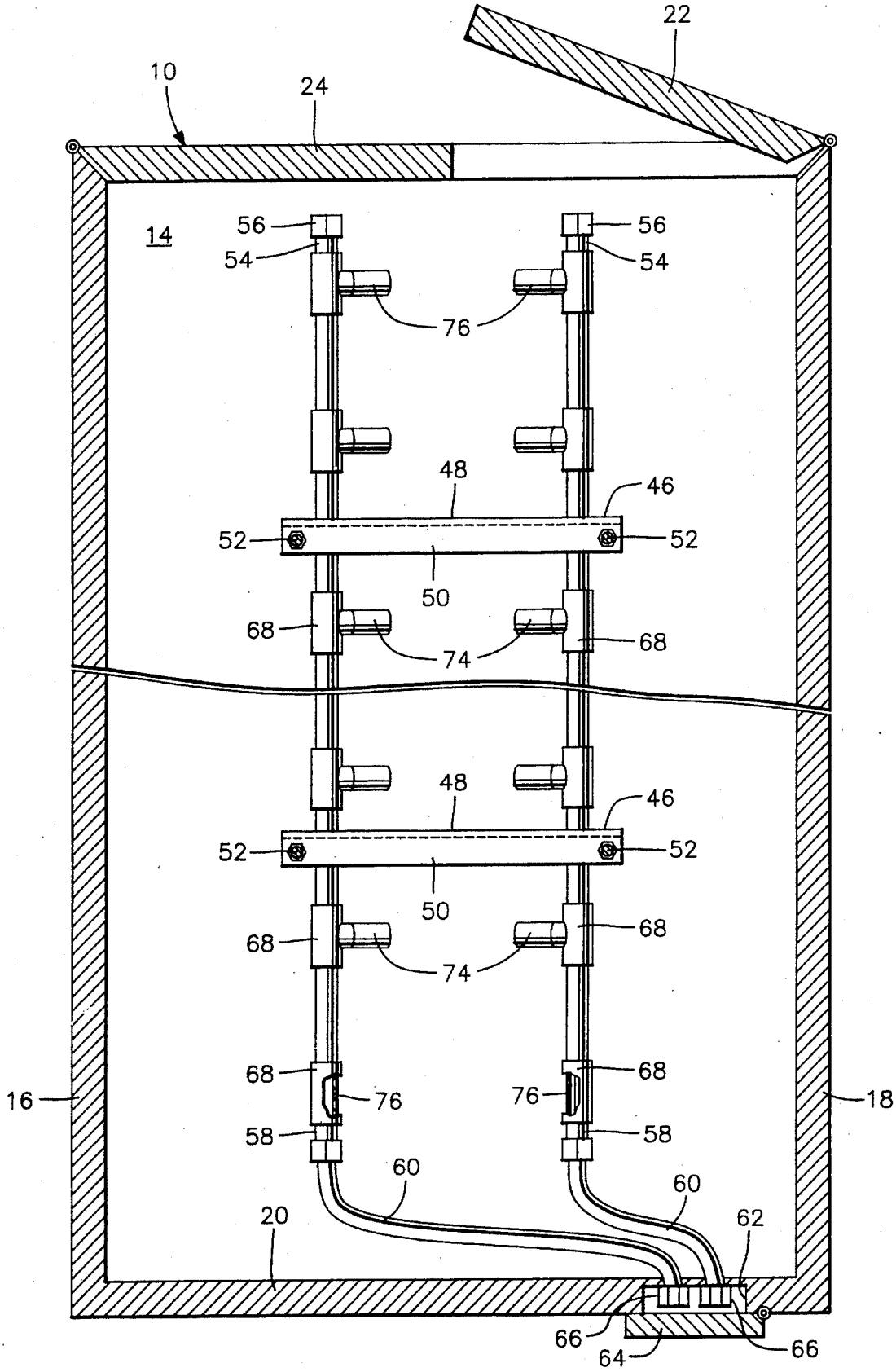
FIG. 2 is an enlarged fragmentary horizontal sectional view illustrating the $CO_2$ spray header and the front access door providing access to the couplers for $CO_2$ and water under pressure.

After the load 72 has been positioned within the container, the doors 22 and 24 are closed and liquid $CO_2$, only, is admitted into the supply pipe or hose 60 connected to the pipe 42 and discharged from the horns 74 supported from the pipe 42 until such time the temperature of the interior of the container has been dropped to below 32° F. and it has been determined that substantially all of the previous ambient atmosphere within the container 10 has been vented therefrom through the vent openings 26 and 28 and replaced by $CO_2$ gas. Then, water under pressure is supplied to the pipe 40 through the corresponding supply pipe or hose 60 and the spray jets of liquid $CO_2$ and water discharged through the apertures 76 and the pipes 40 and 42 are directed toward each other (and slightly downwardly) for impingement with each other in such a manner that substantially of the spray discharged water is turned into ice. The ice layer 70 then builds up over the load 72 in the manner illustrated in FIG. 3.

Water is supplied to the pipe 40 at substantially ground temperature and at 150 psig. The liquid $CO_2$ is supplied to the pipe 42 at substantially 0° F. and at 300 psig.

Depending upon variances in the temperature of the water supplied to the pipe 40 and variances in the size of the apertures 74 in the pipe 40 or the apertures 74 in the pipe 42, the temperature of the ice layer 70 may be varied. If the load comprises ambient temperature or chilled produce it is desired that the temperature of the ice layer 70 be approximately 32°. If the load 72 comprises milk which needs to be maintained between 34° F. and 36° F. the temperature of the ice layer 70 will be 28° F. If the load 72 comprises fresh meat which needs to be maintained at 28° F. to 36° F., the ice layer 70 will be 30° F.

If on the other hand the load 72 comprises frozen meats, vegetables or fish which need to be maintained at −5° F. to 0° F., the ice layer will be −20° F. Finally, if the load 72 is ice cream which needs to be maintained at −5° F. to −10° F., the ice layer 70 will be −30° F. Of course, as the requirement temperature for the ice layer 70 lowers, the pressure of the water may be reduced, the size of the apertures 74 in the pipe 40 may be reduced, or the size of the apertures 74 in the pipe 42 may be increased.

It is pointed out that in order to obtain any reasonable quantity ice through utilization of the spray header assembly 38 it is imperative that substantially of the ambient atmosphere originally within the container 10 be purged therefrom and substantially fully replaced by an atmosphere of chilled $CO_2$ at a temperature below 32° F. Furthermore, it is imperative that the impinging spray jets of water and liquid $CO_2$ be oppositely directed so as to define an included angle of no less than 115°. Furthermore, it has been found that spray jets which are spaced approximately 10½ inches apart serve to produce the maximum amount of ice.

As hereinbefore set forth, the pipes 40 and 42 are insulated. If they were not insulated the water pipe, over a given period of operation would become excessively chilled, as would, the pipe 42 and the ability to control the temperature of the ice being formed would be lost. Furthermore, the spray jets of ice and water are inclined downwardly to prevent ice from the spray jets of one pipe from building up ice on the other pipe. This maintains the spray header assembly 38 substantially completely ice free such that its mounting from the top wall 12 need not be over engineered to support many times the weight of the spray header 38.

If it is before hand known that the spray header assembly 38 is to be utilized in producing ice substantially lower than 30° F., the apertures 74 therein may be increased in diameter. However, such increase in the diameter of the aperture 74 in the pipe 42 will prevent the spray header assembly 38 from being capable of producing ice at 32° F.

It is to be noted that the ice maker is operative in a substantially open, but controlled environment and that it does not require substantially fully closed ice making chambers such as that disclosed at 100 in U.S. Pat. No. 4,838,039. Furthermore, the ice produced by the spray header assembly 38 is substantially evenly disposed over the load 72.

Also, the ice maker or spray header assembly 38 does not require precise relative positioning the opposing horns 72. Slight misalignment or slight misregistry of the horn 72 only slightly reduces the ice making capacity of the spray head assembly 32. Furthermore, inasmuch as most shipping containers and truck bodies are constructed of standard lengths, spray header assemblies of the instant invention may be readily premanufactured and quickly installed within an associated shipping container or truck body.

It is to be noted that the ice maker of the instant invention is not well suited (over a mechanical refrigeration system) in situations wherein the load 72 is to be maintained chilled or frozen for periods of less that two days, inasmuch as containers in which refrigerated foods are carried for less than two days are frequently opened. However, when foods are to be stored or shipped for three days or more, the ice maker of the instant invention becomes very economical, especially with high volume users of liquid $CO_2$. The estimated cost of purchase, mounting and use of a diesel mechanical refrigeration unit, over a period of time, is approximately three times the cost of the fuel consumed thereby and such mechanical refrigeration units consume approximately one gallon of diesel fuel per hour. This translates to approximately three dollars per hour operating cost considering original purchase, mounting, fueling and maintaining a mechanical refrigeration system for a forty foot insulated semitrailer body. However, over a three day period a container such as the container 10 (maintained closed) may be amply chilled through the utilization of an amount of liquid $CO_2$ and water representing less cost and with substantially no danger of malfunction or needed maintenance once the load 72 has been covered with the ice layer 70.

The foregoing is considered as illustrative only of the principles of the invention. Further, since numerous modifications and changes readily will occur to those skilled in the art, it is not desired to limit the invention to the exact construction and operation shown and described, and accordingly, all suitable modifications may be resorted, falling within the scope of the invention.

What is claimed as new is as follows:

1. An apparatus for forming ice in an open, chilled $CO_2$ atmosphere environment, said apparatus including opposing spaced apart water and liquid $CO_2$ jet discharge structures relatively arranged to discharge generally horizontal, opposing fine jets of water and liquid $CO_2$, respectively, toward open opposing impingement with each other, and supply means operative to selectively and/or simultaneously supply water and liquid $CO_2$, respectively, to said water and liquid $CO_2$ jet discharge structures.

2. The apparatus of claim 1 wherein said jet discharge structures are disposed to discharge downwardly and outwardly inclined jets of water and liquid $CO_2$ therefrom along relatively inclined paths defining an included angle of no less than 115 degrees.

3. The apparatus of claim 2 wherein said jets of water and liquid $CO_2$ are downwardly and outwardly inclined generally 30° relative to a horizontal plane.

4. In combination with a shipping container to be used in chilling and/or maintaining chilled a load of produce and/or meats therein during storage and/or shipment of said load and having a chilled, $CO_2$ atmosphere therein, an apparatus for forming and spreading ice within said container over said load, said apparatus including opposing spaced apart water and liquid $CO_2$ jet discharge structures supported in elevated positions within said container above said load and relatively arranged to generally opposing fine jets of water and liquid $CO_2$, respectively, toward open opposing impingement with each other, and supply means operative to selectively and/or simultaneously supply water and liquid $CO_2$, respectively, to said water and liquid $CO_2$ jet discharge structures.

5. The combination of claim 4 wherein said jet discharge structures are disposed to discharge downwardly and outwardly inclined jets of water and liquid $CO_2$ therefrom along relatively inclined paths defining an included angle of no less than 115 degrees.

6. The combination of claim 5 wherein said jets of water and liquid $CO_2$ are downwardly and outwardly inclined generally 30° relative to a horizontal plane.

7. The method of forming ice within a shipping container to be used in chilling and/or maintaining chilled produce and/or meats chilled or frozen during storage and/or shipment, said method including providing a warm shipping container including vent means for venting atmosphere therefrom in excess of ambient atmospheric pressure, initially chilling the interior of said container by discharging liquid $CO_2$ thereinto in a manner whereby the resultant chilled $CO_2$ gas formed in said container will displace substantially all of the original atmosphere of the interior of said container outwardly therefrom by said vent means, and thereafter discharging, in said container, high pressure, generally oppositely directed and impinging jets of water and liquid $CO_2$.

8. The method of claim 7 wherein said container is horizontally elongated and partially filled with items to be iced, said discharging impinging jets of water and liquid $CO_2$ being carried out within said container at an elevation spaced above and vertically registered with said items.

9. The method of claim 8 wherein said discharging impinging jets of water and liquid $CO_2$ is carried out at multiple locations spaced longitudinally along said container.

10. The method of claim 9 wherein said multiple locations each include a pair of impinging jets spaced generally equally on opposite sides of the longitudinal center line of said container.

* * * * *